US009417584B2

(12) United States Patent
Yamada

(10) Patent No.: US 9,417,584 B2
(45) Date of Patent: Aug. 16, 2016

(54) PRINTER

(71) Applicant: Funai Electric Co., Ltd., Osaka (JP)

(72) Inventor: Masahiro Yamada, Osaka (JP)

(73) Assignee: Funai Electric Co., Ltd., Osaka (JP)

( * ) Notice: Subject to any disclaimer, the term of this patent is extended or adjusted under 35 U.S.C. 154(b) by 0 days.

(21) Appl. No.: 14/811,423

(22) Filed: Jul. 28, 2015

(65) Prior Publication Data

US 2016/0026139 A1 Jan. 28, 2016

(30) Foreign Application Priority Data

Jul. 28, 2014 (JP) ..... 2014-152880

(51) Int. Cl.

| | |
|---|---|
| ***G03G 15/00*** | (2006.01) |
| ***G03G 15/23*** | (2006.01) |
| ***B65H 7/02*** | (2006.01) |
| ***B65H 85/00*** | (2006.01) |

(52) U.S. Cl.

CPC ..... *G03G 15/55* (2013.01); *G03G 15/234* (2013.01); *G03G 15/6529* (2013.01); *G03G 2215/00561* (2013.01); *G03G 2215/00565* (2013.01); *G03G 2215/00586* (2013.01)

(58) Field of Classification Search

CPC ..... G03G 15/00; G03G 15/23; G03G 21/00; G03G 15/55; G03G 15/6529; G03G 15/234; G03G 15/00561; G03G 2215/00565; G03G 2215/00586; B65H 7/00; B65H 7/02; B65H 7/06; B65H 7/08; B65H 7/10; B65H 85/00; B65H 9/00; B41J 2/01

USPC ..... 399/361, 363, 364, 381, 401; 347/104

See application file for complete search history.

(56) References Cited

U.S. PATENT DOCUMENTS

| | | | | |
|---|---|---|---|---|
| 6,719,469 | B2 * | 4/2004 | Yasui | B41J 13/0045 400/603 |
| 2006/0269337 | A1 * | 11/2006 | Yasumoto | G03G 15/232 399/388 |
| 2007/0242997 | A1 * | 10/2007 | Takahashi | B41J 3/60 399/395 |
| 2008/0309989 | A1 * | 12/2008 | Shirai | B65H 7/06 358/474 |
| 2010/0276863 | A1 * | 11/2010 | Yano | B65H 9/004 271/3.14 |
| 2010/0308532 | A1 * | 12/2010 | deJong | B65H 5/34 271/227 |
| 2011/0052292 | A1 * | 3/2011 | Prabhat | G03G 15/6561 399/395 |
| 2011/0097125 | A1 * | 4/2011 | deJong | G03G 15/6564 399/394 |
| 2011/0156345 | A1 * | 6/2011 | deJong | B65H 9/002 271/228 |

FOREIGN PATENT DOCUMENTS

| | | | | |
|---|---|---|---|---|
| JP | 2000335783 A | * | 12/2000 | B65H 7/02 |
| JP | 2003-155162 A | | 5/2003 | |
| JP | 2007191232 A | * | 8/2007 | G03G 15/00 |

* cited by examiner

*Primary Examiner* — Nguyen Ha
*Assistant Examiner* — Wyn Ha
(74) *Attorney, Agent, or Firm* — Osha Liang L.L.P.

(57) ABSTRACT

A printer that reverses a direction of movement of a medium, includes a detection member that detects a slant in the medium relative to the direction of movement of the medium, based on at least two contact points between the detection member and the medium.

20 Claims, 13 Drawing Sheets

PRINTER

TECHNICAL FIELD

The present invention relates to a printer that can perform double-sided printing.

BACKGROUND ART

In printers that can print on both sides of a printer paper, depending on the print unit, the paper is turned over and sent into the print unit again after printing on one side of the paper. In this manner, printing is performed by the print unit on the other side of the paper, and double-sided printing is realized.

The turning over of the paper is, for example, performed in the following manner. First, a paper that has been printed on one side is fed in a forward direction along the discharge route. Then, while the paper is being fed in a forward direction along the discharge route, the direction of movement of the paper is reversed and the paper is fed in the reverse direction. The paper fed in the reverse direction is then sent into the turnover route for turning over the paper.

When reversing the direction of movement for turning over the paper, there are cases when the paper cants diagonally relative to the direction of movement. When the paper cants diagonally, it becomes difficult to print the image appropriately. At this point, it is desirable to detect that the paper has canted diagonally.

For example, in Patent Literature 1, the degree to which the paper is diagonal is detected by detecting the edge face position of the feed direction of the paper using two sensors in different positions in the width direction and orthogonal to the feed direction of the paper.

PRIOR ART DOCUMENTS

Patent Literature

[Patent Literature 1] Japanese Unexamined Patent Application Publication No. 2003-155162

However, in the conventional technique, a plurality of sensors is required for detecting the end surface position of the paper. Further, high precision in the attachment position of the plurality of sensors is required because the difference in end surface position is used when the paper passes through diagonally. In this manner, in the conventional technique, a plurality of sensors is required and the man-hours for building the printer increases.

SUMMARY OF THE INVENTION

One or more embodiments of the present invention provide a printer that can reduce the number of sensors for determining abnormalities in the feed condition of sheet-shaped recording media.

In one or more embodiments of the present invention, a printer performs double-sided printing by turning over a recording medium (or "medium") by reversing the direction of movement while the recording medium is being fed in the forward direction along a discharge route for discharging a printed sheet-shaped recording medium and feeding the recording medium in a reverse direction, including a displacement member (or "detection member") disposed on the discharge route that displaces by contacting the recording medium, a detector for detecting the passage of an end edge of the recording medium as it is fed in the forward direction over the discharge route and the passage of the end edge of the recording medium as it is fed in the reverse direction over the discharge route by detecting the displacement of the displacement member, and a determining part for determining that the feed condition of the recording medium is abnormal when the value showing the difference between a forward feed amount of the recording medium from when the passage of the end edge of the recording medium during feeding in the forward direction is detected until the direction of movement of the recording medium is reversed and a reverse feed amount of the recording medium from when the direction of movement of the recording medium is reversed until the passage of the end edge of the recording medium during feeding in the reverse direction is detected is above a threshold.

According to one or more embodiments of the present invention, the passage of the end edge of the recording medium during feeding in the forward direction and the passage of the end edge of the recording medium during feeding in the reverse direction can be detected by detecting the displacement of the displacement member. Further, abnormalities in the feed condition of a sheet-shaped recording medium can be determined by using a forward feed amount and a reverse feed amount based on the passage of the end edge of the recording medium during feeding in the forward direction and the passage of the end edge of the recording medium during feeding in the reverse direction that are detected in this manner. In other words, if the displacement of the displacement member can be detected, abnormalities in the feed condition can be determined The displacement of the displacement member can be detected without using a plurality of sensors. Thus, the number of sensors for determining abnormalities in the feed condition of a recording medium can be reduced.

Further, according to one or more embodiments of the present invention, abnormalities in the feed condition can be determined by comparing the forward feed amount and the reverse feed amount. Thus, even when using recording mediums of a plurality of sizes, abnormalities in the feed conditions of the recording medium can be determined appropriately. In other words, abnormalities in the feed conditions can be determined more adaptively relative to the size of the recording medium than when comparing the reverse feed amount to a predetermined feed amount.

For example, the displacement member may be equipped with a long shaft supported to allow rotation around a width direction orthogonal to the direction of movement of the recording medium and extending in the width direction, and a plurality of levers, each extending to the route surface of the discharge route from the shaft, disposed apart from each other in the width direction; and the detector may detect the passage of the end edge of the recording medium during feeding in the forward direction over the discharge route and the passage of the end edge of the recording medium during feeding in the reverse direction over the discharge route by detecting the rotation of the shaft due to the contact of at least one of the plurality of levers contacting the recording medium.

According to one or more embodiments of the present invention, the passage of the end edge of the recording medium can be detected by detecting the rotation of the shaft due to the contact of the recording medium with at least one of the plurality of levers. Because the plurality of levers are disposed apart from each other in the width direction, the change in the reverse feed amount relative to the forward feed amount due to a slant in the recording medium relative to the direction of movement can be detected more accurately. In other words abnormalities in the feed condition of the recording medium can be determined more accurately.

For example, the printer may be able to perform double-sided printing on a recording medium of a first size and a recording medium of a second size that is smaller than the first size, and the plurality of levers may include a first lever and a second lever disposed in a position corresponding to both end parts in the width direction of the recording medium of the first size, and a third lever disposed in a position corresponding to one end part in the width direction of the recording medium of the second size.

According to one or more embodiments of the present invention, the third lever is disposed in a position corresponding to the end part of one side in the width direction of the recording medium of the second size, in a position between the first lever and the second lever. Thus, the change in the reverse feed amount relative to the forward feed amount due to the slant in the recording medium of the second size can be detected more accurately. In other words, in addition to the recording medium of the first size, abnormalities in the feed condition of the recording medium of the second size can be detected more accurately.

For example, each of the plurality of levers may have a slanted part that is disposed canting in the reverse direction relative to the route surface of the discharge route and that collides with the end edge of the recording medium being fed in the forward direction over the discharge route.

According to one or more embodiments of the present invention, in each lever, a slanted part is formed on the part colliding with the end edge of the recording medium fed in the forward direction over the discharge route disposed canted in the reverse direction relative to the route surface of the discharge route. Thus, the force placed on the recording medium when colliding can be suppressed, allowing for a more stable feed of the recording medium. According to one or more embodiments of the present invention, a printer that reverses a direction of movement of the recording medium, comprises a detection member that detects a slant in the recording medium relative to the direction of movement of the recording medium, based on at least two contact points between the detection member and the recording medium.

In one or more embodiments of the present invention, a printer can determine abnormalities in the feed condition of a sheet-shaped recording medium and suppress the increase of man-hours for building.

According to one or more embodiments of the present invention, a method for detecting an abnormal feed condition of a recording medium in a printer that reverses a direction of movement of the recording medium, comprises: detecting a forward passage of an end edge of the recording medium fed in a forward direction and a reverse passage of the end edge of the recording medium fed in a reverse direction; and determining whether a difference between a forward feed amount of the recording medium fed in the forward direction and a reverse feed amount of the recording medium fed in the reverse direction is above a threshold.

BRIEF DESCRIPTION OF THE DRAWINGS

FIG. 4 (b) is a drawing for describing the displacement member of a printer according to one or more embodiments of the present invention.

FIG. 7 (b) is a drawing for describing the processes of a printer according to one or more embodiments of the present invention.

FIG. 7 (c) is a drawing for describing the processes of a printer according to one or more embodiments of the present invention.

FIG. 8 (b) is a drawing for describing the processes of a printer according to one or more embodiments of the present invention when the feed condition is normal.

FIG. 8 (c) is a drawing for describing the processes of a printer according to one or more embodiments of the present invention when the feed condition is normal.

DETAILED DESCRIPTION OF THE INVENTION

Embodiments of the present invention are described in detail below with reference to drawings.

Embodiments described below show an exhaustive and specific example. The numerical values, materials, configuration elements, the arrangement position of the configuration elements, and connection configuration and the like shown in the embodiments below are one example, and are not meant to limit the scope of the claims. Further, among the configuration elements of the embodiments below, configuration elements not stated in an independent claim are described as arbitrary configuration elements.

(Embodiments)

[Physical Configuration of the Printer]

Figure 1:
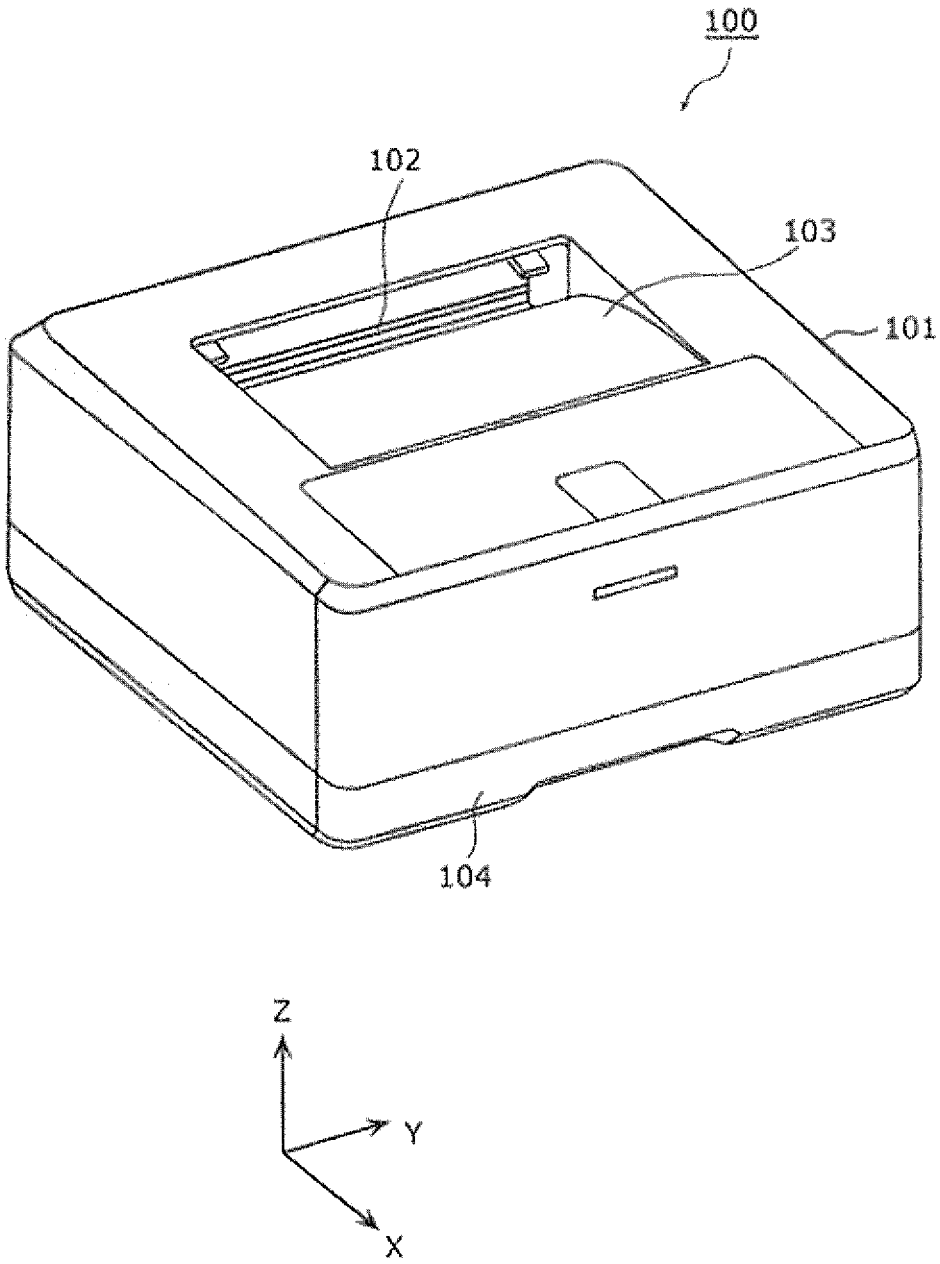
FIG. 1 is a perspective view illustrating the exterior appearance of a printer according to one or more embodiments of the present invention.

A physical configuration of a printer 100 in accordance with one or more embodiments of the present invention is described first. FIG. 1 is a perspective view showing an exterior view of the printer 100 according to one or more embodiments of the present invention.

The printer 100 performs double-sided printing by turning over the paper by feeding the paper in a reverse direction by reversing the direction of movement while the paper is fed in the forward direction along the discharge route for discharging the printed paper. In one or more embodiments of the present invention, the printer 100 is a laser printer.

As illustrated in FIG. 1, the printer 100 is equipped with a chassis 101, a discharge port 102 formed on the chassis 101, a catch tray 103, and a paper cassette 104.

The discharge port 102 is an aperture through which printed paper is discharged from the interior of the chassis 101. When double-sided printing is performed, the direction of movement of a paper printed on one side (first side) is reversed while it is being discharged from the discharge port 102, and returns to the interior of the chassis 101.

The catch tray 103 is formed on the upper surface of the chassis 101. The paper discharged from the discharge port 102 sits on the catch tray 103.

The paper cassette 104 is provided on the lower part of the chassis 101, and is stored in the chassis 101 such that it can be drawn out. Printing paper is stacked in the paper cassette 104.

Figure 2:
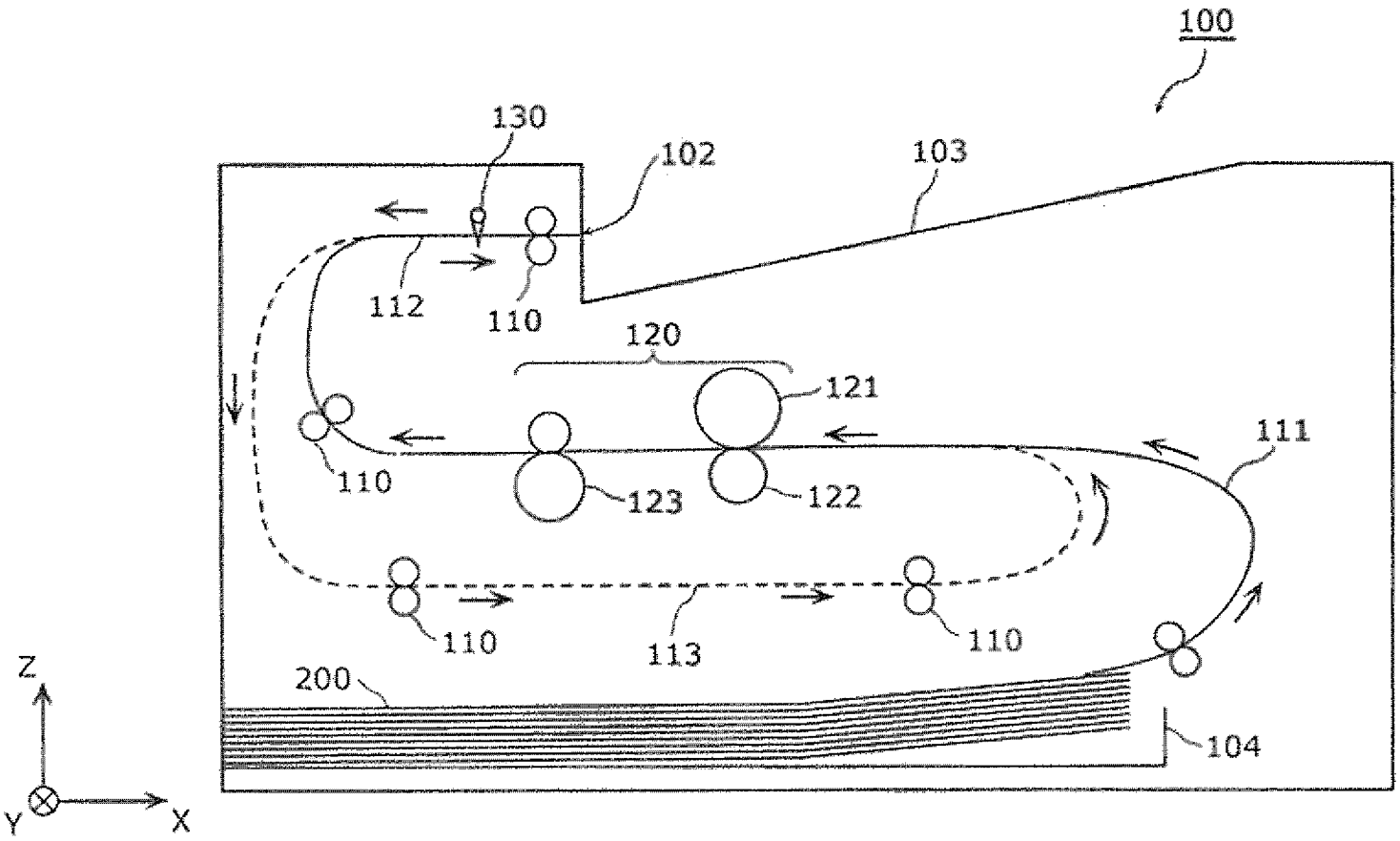
FIG. 2 is a drawing illustrating the feed route of the paper inside a printer according to one or more embodiments of the present invention.

The feed route of the paper within the printer 100 is described next. FIG. 2 is a drawing that illustrates the feed route within the printer 100 in accordance with one or more embodiments of the present invention. The printer 100 is equipped with a feed roller 110, a print unit 120, and a displacement member 130. Also, on the interior of the printer 100, a supply route 111, a discharge route 112, and a reverse route 113 are formed.

The feed roller 110 feeds a paper 200 along the supply route 111, the discharge route 112, and the reverse route 113. The feed roller 110 feeds the paper 200 by rotating via a drive source (not pictured).

The supply route 111 is a route for supplying the paper 200 placed in the paper cassette 104 to the print unit 120. The paper 200 is fed along the supply route 111 by the feed roller 110, and is supplied from the paper cassette 104 to the print unit 120.

The print unit 120 prints an image on the upper side of the paper 200. In other words, an image is printed on one side (first side) of the paper 200 arriving at the print unit 120 from the supply cassette 104.

Specifically, the print unit 120 contains a photoreceptor drum 121, a transcription roller 122, and a fixing roller 123. A toner image is formed on the surface of the photoreceptor drum 121. The toner image formed on the surface of the photoreceptor drum 121 is transcribed onto the upper surface of the paper 200 by the transcription roller 122. Then, the fixing roller 123, by adding heat and pressure to the toner image transcribed onto the upper surface of the paper 200, fixes the toner image onto the paper 200.

The discharge route 112 is a route for discharging the paper 200 that has been printed by the print unit 120 to the catch tray 103. The printed paper 200 is fed along the discharge route 112 by the feed roller 110, and is discharged to the exterior of the chassis 101 from the discharge port 102. The direction in which the paper 200 is discharged to the exterior of the chassis 101 is called the forward direction.

When double-sided printing is performed, the paper 200 on which an image has been printed on only one side reverses its direction of movement while being discharged from the discharge port 102, and returns to the interior of the chassis 101. The direction in which the paper 200 returns to the interior of the chassis 101 is called the reverse direction.

The reverse route 113 is a route for turning over the paper 200. The paper 200 fed in the reverse direction along the discharge route 112 enters the reverse route 113. Then, the paper 200 fed along the reverse direction 113 by the feed roller 110 is supplied again to the print unit 120.

At this point, the bottom side of the paper 200 supplied again to the print unit 120 is the first side onto which an image has already been printed. In other words, the upper side of the paper 200 is a second side opposite the first side. Thus, an image is printed onto the second side of the paper 200 supplied again to the print unit 120. In other words, an image is printed onto both sides of the paper 200. p The paper 200 onto which an image has been printed on both the first side and the second side is fed along the discharge route 112, discharged to the exterior of the chassis 101 from the discharge port 102, and is placed in the catch tray 103.

The displacement member 130 is installed on the discharge route 112, and is displaced by contacting the paper 200. Details of the displacement member 130 are described below using FIG. 3 and FIG. 4.

Figure 3:
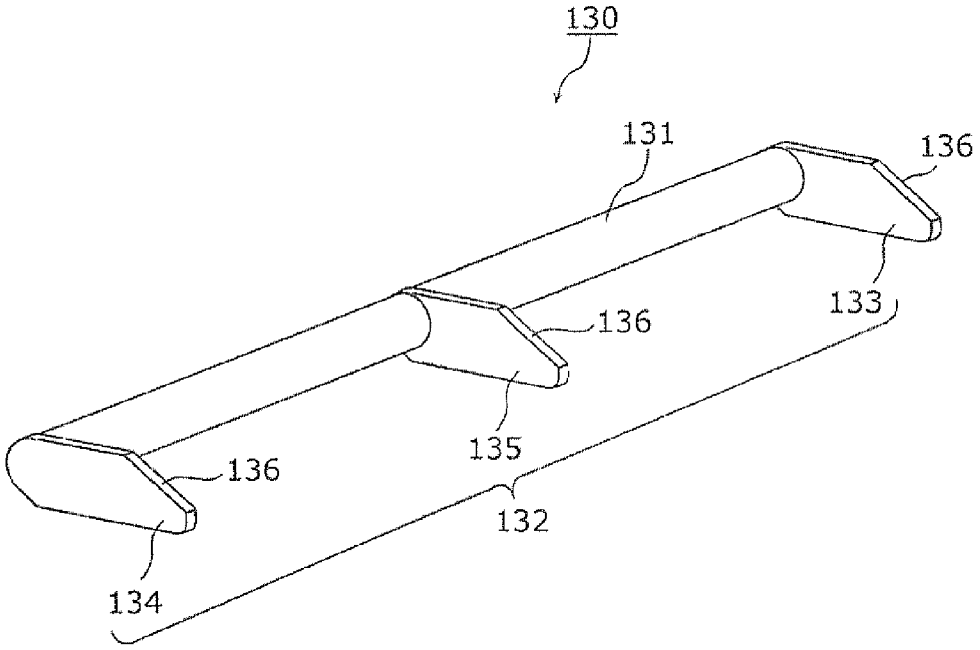
FIG. 3is a perspective view of the displacement member of a printer according to one or more embodiments of the present invention.
Figure 4A:
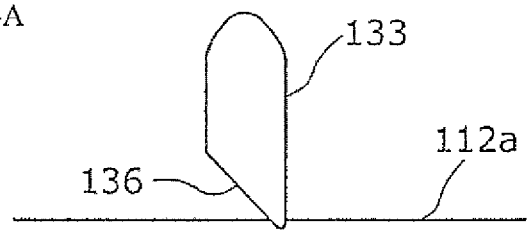
FIG. 4 (a) is a drawing for describing the displacement member of a printer according to one or more embodiments of the present invention.
Figure 4B:
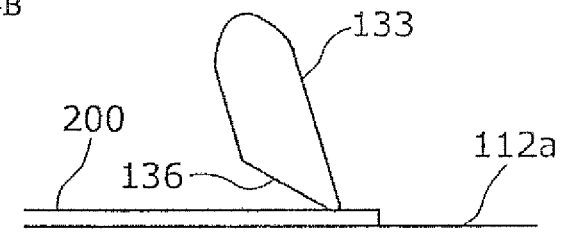
Figure 4B:
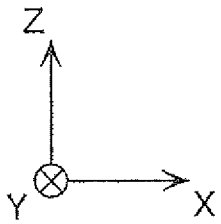

FIG. 3 is a perspective view of the displacement member 130 of the printer 100 in one or more embodiments of the invention. FIG. 4 is a drawing for describing the displacement of the displacement member 130 of the printer 100 according to one or more embodiments of the present invention.

The displacement member 130 is equipped with a shaft 131 and a plurality of levers 132, as illustrated in FIG. 3.

The shaft 131 is a long member extending in the width direction (Y-axis direction) orthogonal to the direction of movement of the paper 200 (X-axis direction). Here, the shaft 131 is disposed above the route surface 112*a* of the discharge route 112.

The plurality of levers 132 each extend from the shaft 131 to the route surface 112*a* of the discharge route 112, and are disposed apart from each other in the width direction (Y-axis direction). In other words, the plurality of levers 132 are provided on the shaft 131 and are disposed such that they protrude toward the route surface 112*a* of the discharge route 112.

As illustrated in FIG. 4 (a), each of the plurality of levers 132 are disposed crossing the route surface 112*a* of the discharge route 112 when not in contact with the paper 200. Thus, as illustrated in FIG. 4 (b), the paper 200 fed over the discharge route 112 contacts the plurality of levers 132, and push up on the plurality of levers 132. As a result, the shaft 131 rotates.

Further, as illustrated in FIG. 3 and FIG. 4, each of the plurality of levers 132 has a slanted part 136 disposed leaning in a reverse direction relative to the route surface 112*a* of the discharge route 112. In other words, an acute angle is formed by the slanted part 136 and the route surface 112*a* positioned in the reverse direction (the negative X-axis side) from the slanted part 136. The slanted part 136 collides with the end edge of the direction of movement of the paper 200 fed in the forward direction over the discharge route 112.

In one or more embodiments of the present invention, the plurality of levers 132 contains a first lever 133, a second lever 134, and a third lever 135.

The first lever 133 and the second lever 134 are disposed in a position corresponding to both end parts in the width direction (Y-axis direction) of the paper 200. In other words, the first lever 133 is disposed in a position that one end part in the width direction of the paper 200 passes through. The second lever 134 is disposed in a position that the other end part in the width direction of the paper 200 passes through. Here, the first lever 133 and the second lever 134 are each provided on the end portions in the longitudinal direction (Y-axis direction) of the shaft 131.

The third lever 135 is disposed between the first lever 133 and the second lever 134. Here, the third lever 135 is provided at the center point of the first lever 133 and the second lever 134 in the longitudinal direction of the shaft 131.

[Function Configuration of the Printer]

Figure 5:
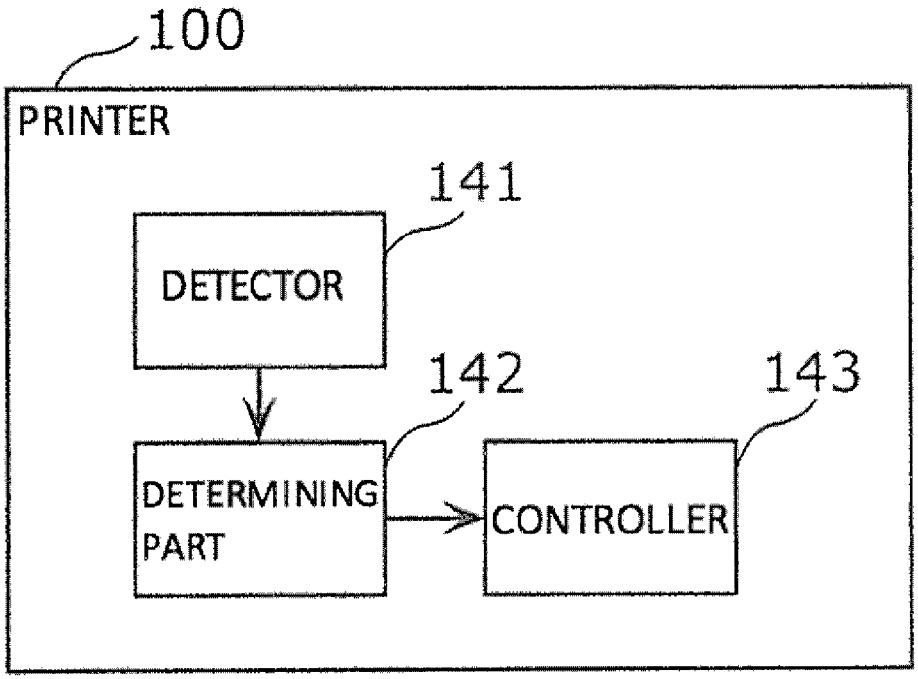
FIG. 5 is a block drawing illustrating the function configuration of a printer according to one or more embodiments of the present invention.

The function configuration of the printer 100 in accordance with one or more embodiments of the present invention is described next. FIG. 5 is a block drawing illustrating the function configuration of the printer 100 according to one or more embodiments of the present invention.

As illustrated in FIG. 5, the printer 100 is equipped with a detector 141, determining part 142, and a controller 143.

The detector 141, by detecting the displacement of the displacement member 130, detects the passage of the end edge of the paper 200 while being fed in the forward direction over the discharge route 112, and the passage of the end edge of the paper 200 while it is being fed in the reverse direction over the discharge route 112.

In other words, when the paper 200 is fed in the forward direction, the detector 141 detects that the front side end edge of the paper 200 in the direction of movement (forward direction) has contacted one of the plurality of levers 132. Said differently, when the paper 200 is fed in the forward direction, the detector 141 detects the passage of the front end edge of the paper 200.

When the paper 200 is fed in the reverse direction, the detector 141 detects that the back end edge of the paper 200 in the direction of movement (reverse direction) has passed the plurality of levers 132. Said differently, when the paper 200 is fed in the reverse direction, the detector 141 detects the passage of the back end edge of the paper 200.

Specifically, the detector 141, for example, detects the displacement of the displacement member 130 by detecting the rotation conditions of the shaft 131. More specifically, the detector 141, for example, detects the displacement of the displacement member 130 by detecting the front end portion of the L-shaped protrusion protruding from the longitudinal end portion of the shaft 131 using a photointerruptor. In this case, for example when the signal from the photointerruptor switches from "ON" to "OFF", the detector 141 detects the passage of the end edge of the paper 200 while it feeds in the forward direction over the discharge route 112. Meanwhile, for example when the signal from the photointerruptor switches from "OFF" to "ON", the detector 141 detects the passage of the end edge of the paper 200 in the reverse direction over the discharge route 112.

The determining part 142 determines the feed condition of the paper 200 as abnormal when the value showing the difference between the forward feed amount of the paper 200 and the reverse feed amount of the paper 200 is above threshold. Here, the forward feed amount is the feed amount of the paper 200 from when the passage of the end edge of the paper 200 being fed in the forward direction is detected until the direction of movement of the paper 200 is reversed. The reverse feed amount is the feed amount from when the direction of movement of the paper 200 is reversed until the passage of the end edge of the paper 200 being fed in the reverse direction is detected.

Feed amount corresponds to the distance the paper 200 is fed. Specifically, feed amount is, for example, the number of rotations of the feed roller 110. As another example, when the absolute value of the acceleration of the paper 200 in the forward direction and in the reverse direction is equal, the feed amount may be the time required for feeding.

The value showing the difference between the forward feed amount and the reverse feed amount is, for example, the absolute value of the difference between the forward feed amount and the reverse feed amount, the difference between the forward feed amount and the reverse feed amount squared, or a ratio of the forward feed amount relative to the reverse feed amount. The value showing the difference between the forward feed amount and the reverse feed amount need not be limited to these.

The threshold is experientially or experimentally determined beforehand. The smaller the threshold is, the more likely it becomes that the feed condition is determined to be abnormal. For example, when the threshold is "0", the determining part 142 determines the feed condition to be abnormal if the forward feed amount and reverse feed are not equal.

The controller 143 controls various operations of the printer 100. For example, the controller 143 controls the feed of the paper 200 by controlling the rotation of the feed roller 110. Also, the controller 143 may alert the user of an abnormality in the feed condition by igniting a lamp (not pictured).

[Operation of the Printer]

Figure 6:
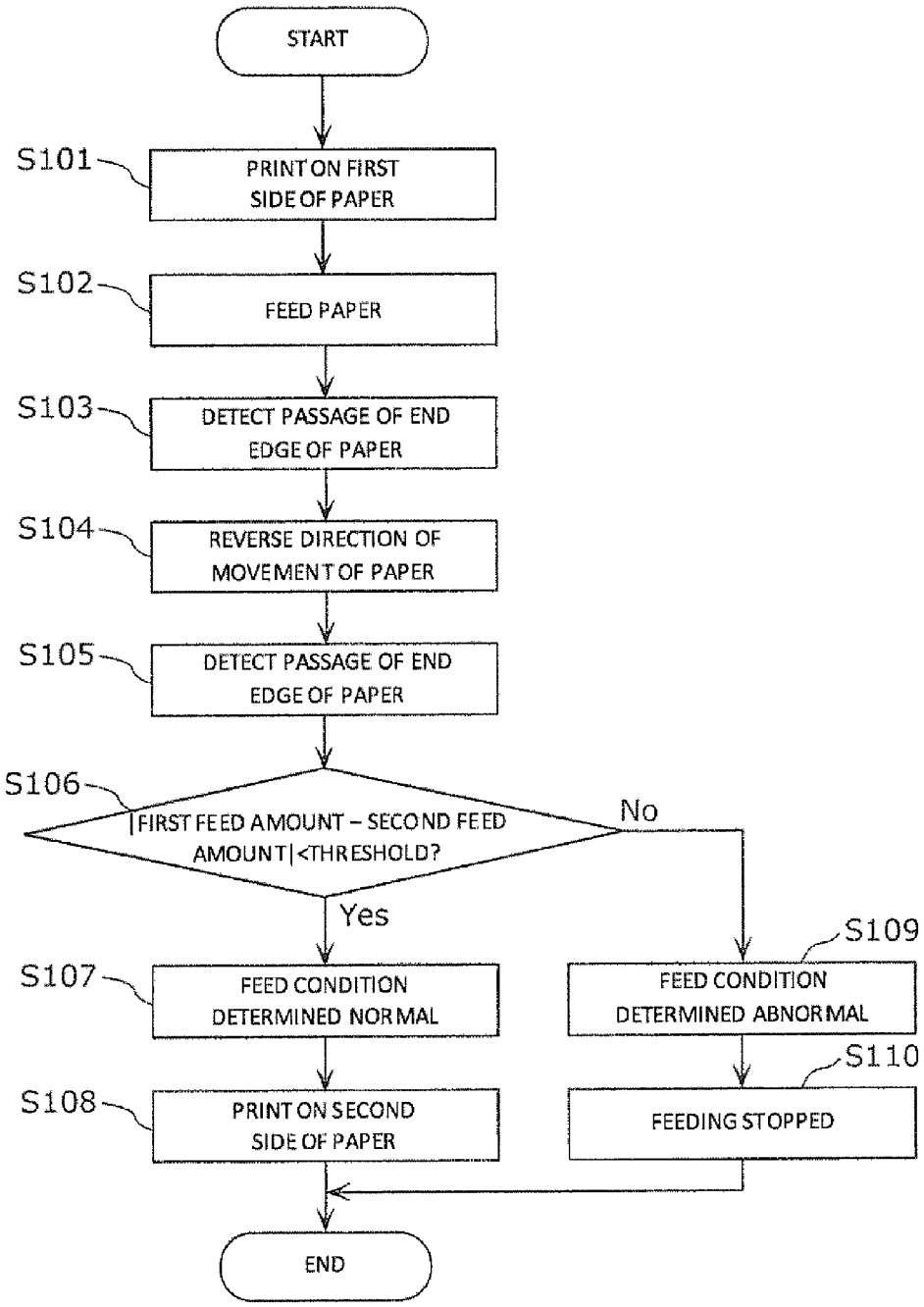
FIG. 6 is a flow chart showing the processes of a printer according to one or more embodiments of the present invention.
Figure 7A:
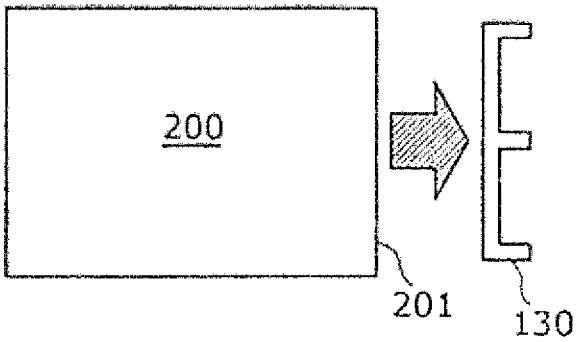
FIG. 7 (a) is a drawing for describing the processes of a printer according to one or more embodiments of the present invention.
Figure 7B:
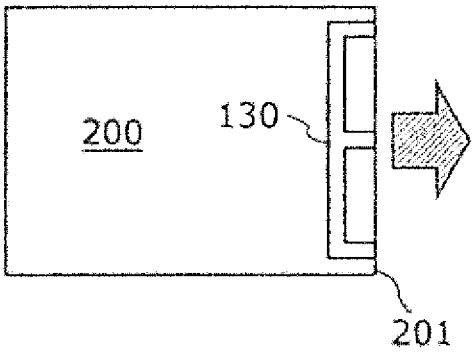
Figure 7C:
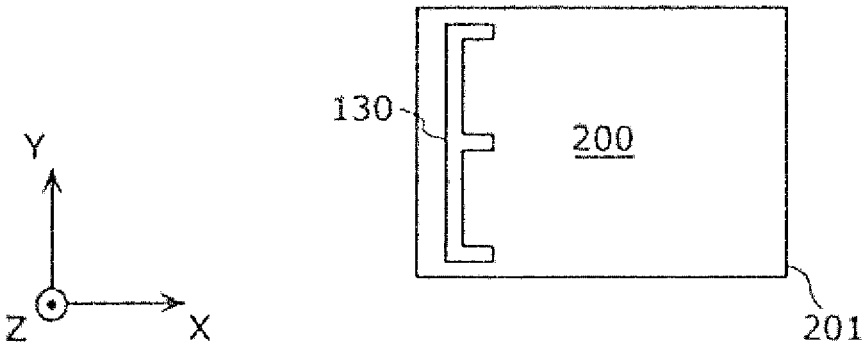
Figure 8A:
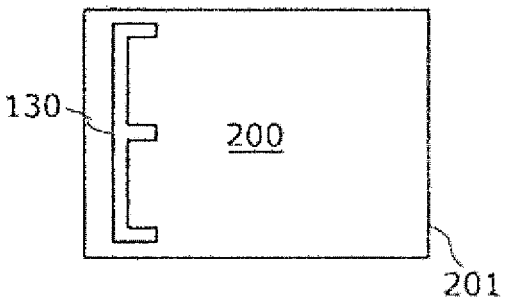
FIG. 8 (a) is a drawing for describing the processes of a printer according to one or more embodiments of the present invention when the feed condition is normal.
Figure 8B:
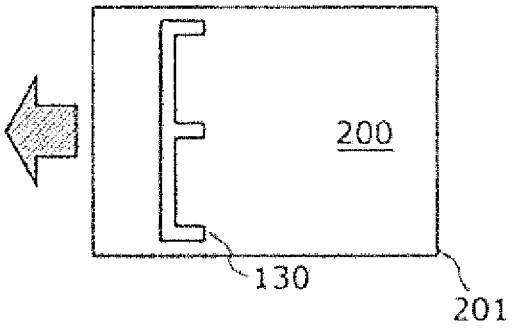
Figure 8C:
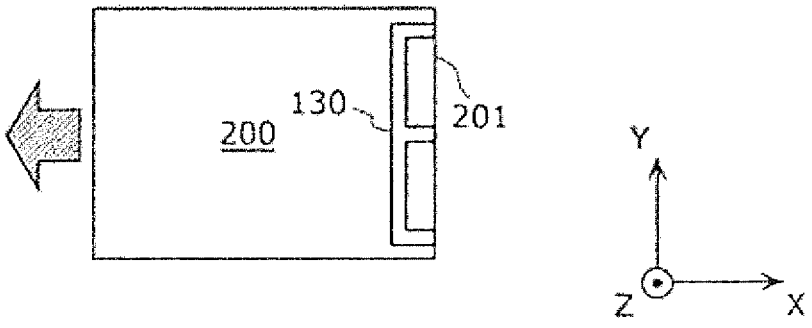
Figure 9A:
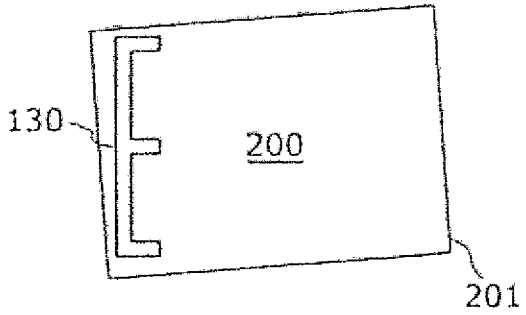
FIG. 9(a) is a drawing for describing the processes of a printer according to one or more embodiments of the present invention when the feed condition is abnormal.
Figure 9B:
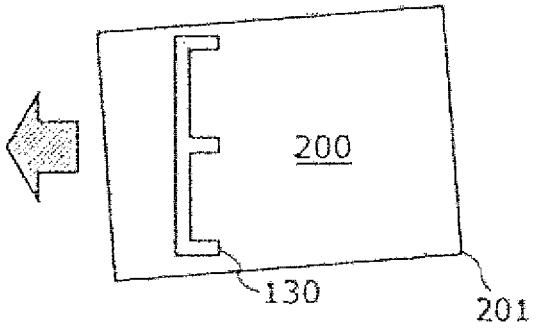
FIG. 9(b) is a drawing for describing the processes of a printer according to one or more embodiments of the present invention when the feed condition is abnormal.
Figure 9C:
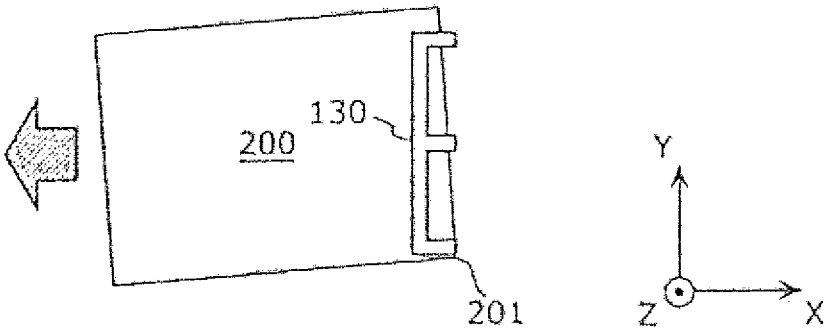
FIG. 9(c) is a drawing for describing the processes of a printer according to one or more embodiments of the present invention when the feed condition is abnormal.

The operation of the printer 100 configured as above is described. FIG. 6 is a flow chart illustrating the processes of the printer 100 in accordance with one or more embodiments of the invention. FIG. 7 is a drawing for describing the processes of the printer 100 according to one or more embodiments of the present invention. FIG. 8 is a drawing for describing the processes when the feed condition of the printer 100 according to one or more embodiments of the present invention is normal. FIG. 9 is a drawing for describing the processes when the feed condition of the printer 100 according to one or more embodiments of the present invention is abnormal.

First, the controller 143 performs printing on the first side of the paper 200 by controlling the print unit 120 (S101). Continuing, the controller 143 feeds the paper 200 in the forward direction along the discharge route 112 by controlling the rotation of the feed roller 110 (S102). As a result, the paper 200 is fed in the forward direction as illustrated in FIG. 7 (a).

The detector 141 detects the passage of the front-side end edge 201 of the paper 200 as it is fed in the forward direction (S103). As illustrated in FIG. 7 (b), when the front-side end edge 201 in the direction of movement of the paper 200 passes under the displacement member 130, the passage of the front end portion of the end edge 201 of the paper 200 is detected by the displacement of the displacement member 130 when it contacts the paper 200.

The controller 143 reverses the direction of movement of the paper 200 (S104). In other words, the controller 143 feeds the paper 200 in the reverse direction be reversing the direction of rotation of the feed roller 110. In the positions illustrated in FIG. 7 (c), FIG. 8 (a), and FIG. 9 (a), the direction of movement of the paper 200 is reversed. Then, as illustrated in FIG. 8 (b) and FIG. 9 (b), the paper 200 is fed in the reverse direction.

Next, the detector 141 detects the passage of the rear-side end edge 201 of the paper 200 as it is fed in the reverse direction (S105). As illustrated in FIG. 8 (c) and FIG. 9 (c), when the rear-side end edge 201 in the direction of movement of the paper 200 passes under the displacement member 130, the passage of the rear end portion of the end edge 201 of the paper 200 is detected by the displacement member 130 returning to its original position, being no longer in contact with the paper 200.

Next, the determining part 142 determines whether the value showing the difference between the forward feed amount and the reverse feed amount is below threshold (S106). Here, the value showing the difference between the forward feed amount and the reverse feed amount is the absolute value of the difference between the forward feed amount and the reverse feed amount.

Here, when the value showing the difference between the forward feed amount and the reverse feed amount is below threshold (Yes of S106), the determining part 142 determines the feed condition of the paper 200 as normal (S107). As a result, the feeding of the paper 200 continues. Then, the paper 200 is fed along the reverse route 113, and is supplied to the print unit 120 in a state of having been turned over. The reason it is determined in this manner is described later using FIG. 10.

Further, the controller 143 performs printing on the second side of the paper 200 by controlling the print unit 120 (S108). The paper 200 with a printed image on both the first side and the second side is fed along the discharge route 112 and discharged into the catch tray 103.

Meanwhile, if the value showing the difference between the forward feed amount and the reverse feed amount is above threshold (Yes of S106), the determining part 142 determines the feed condition of the paper 200 as abnormal (S109). The reason it is determined in this manner is described later using FIG. 10.

Then, the controller 143 stops the feed of the paper 200 (S110). Further, the controller 143 alerts the user that the feed condition of the paper 200 is abnormal.

Figure 10:
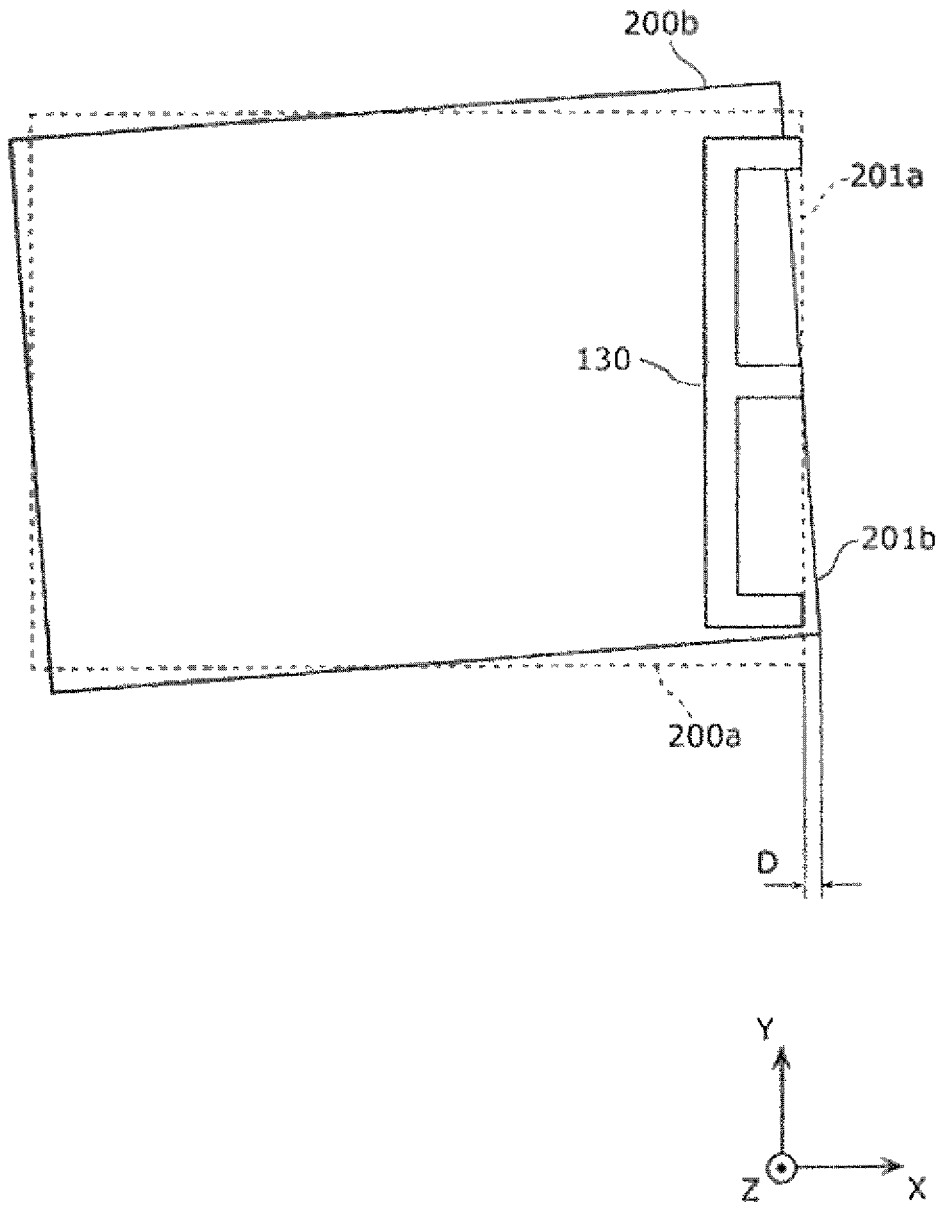
FIG. 10 is a drawing illustrating the difference between the forward feed amount and the reverse feed amount of a printer according to one or more embodiments of the present invention.

Here, the reason for determining the feed condition of the paper 200 as normal/abnormal in step S107 and step S109 of FIG. 6 is described. FIG. 10 is a chart showing the difference between the forward feed amount and the reverse feed amount of the printer 100 according to one or more embodiments of the present invention. In FIG. 10, a paper 200*a* and a paper 200*b* are both shown in the position where the passage of the end edge is detected as they are fed in the reverse direction over the discharge route 112.

When the feed condition is normal, the paper 200*a* is fed in a condition such that it is not canted relative to the direction of movement, as illustrated in FIG. 10 with a dotted line. That is, the end edge 201*a* of the paper 200*a* is perpendicular to the movement direction. In this case, the forward feed amount and the reverse feed amount of the paper 200*a* are substantially equal. Thus, when the value showing the difference between the forward feed amount and the reverse feed amount is below threshold, the determining part 142 determines the feed condition of the paper 200*a* as being normal.

Meanwhile, when the feed condition is abnormal, the paper 200*b* is fed in a condition such that it is canted relative to the direction of movement, as illustrated in FIG. 10 with a solid line. That is, the end edge 201*b* of the paper 200*b* is not perpendicular to the movement direction. In this case, the reverse feed amount of the paper 200*b* is larger than the reverse feed amount of the paper 200*a* by distance D. In other words, the forward feed amount and the reverse feed amount of the paper 200*b* are not equal. Thus, when the value showing the difference between the forward feed amount and the reverse feed amount is above threshold, the determining part 142 determines the feed condition of the paper 200*b* as being abnormal.

[Effects of One or More Embodiments of the Invention]

According to one or more embodiments of the printer 100 of the present invention, the passage of the end edge 201 of the paper 200 as it is fed in the forward direction and the passage of the end edge 201 of the paper 200 as it is fed in the reverse direction can be detected by the displacement of the displacement member 130. Further, abnormalities in the feed conditions of the paper 200 can be determined by using the forward feed amount and the reverse feed amount based on the detection of the passage of the end edge 201 of the paper 200 as it is fed in the forward direction and the passage of the end edge 201 of the paper 200 as it is fed in the reverse direction. In other words, if the displacement of the displacement member 130 can be detected, abnormalities in feed condition can be determined. The displacement of the displacement member 130 can be detected without using a plurality of sensors. Thus, the number of sensors for determining abnormalities in the feed condition of the paper 200 can be reduced.

Also, according to one or more embodiments of the printer 100 of the present invention, abnormalities in feed condition can be determined by comparing the forward feed amount and the reverse feed amount. Thus, even when the paper 200 is used in a plurality of sizes, abnormalities in the feed condition of the paper 200 can be appropriately determined. In other words, abnormalities in the feed condition can be more adaptively determined relating to the size of the paper 200 than when comparing the reverse feed amount to a feed amount determined beforehand.

Also, according to one or more embodiments of the printer 100 of the present invention, by detecting the rotation of the shaft 131 due to the contact of the paper 200 with at least one from among the plurality of levers 132, the passage of the end edge 201 of the paper 200 can be detected. Because the plurality of levers 132 are disposed apart from each other in the width direction, the change in the reverse feed amount relative to the forward feed amount due to a slant in the paper 200 relative to the direction of movement can be detected more accurately. In other words, abnormalities in the feed condition of the paper 200 can be determined more accurately.

Also, according to one or more embodiments of the printer 100 of the present invention, within each of the plurality of levers 132, a slanted part 136 is formed on the portion colliding with the end edge 201 of the paper 200 that is fed in the forward direction over the discharge route 112 disposed canted in the reverse direction relative to the route surface 112*a* of the discharge route 112. Thus, the force placed on the paper 200 when colliding can be suppressed, allowing for a more stable feed of the paper 200.

(Modification 1)

Next, a modification 1 of the embodiments is described. In one or more embodiments of the present modification, the number of levers contained in the displacement member is different than in the above embodiments. The displacement member is described below centered on points that differ from the above embodiments.

Figure 11:
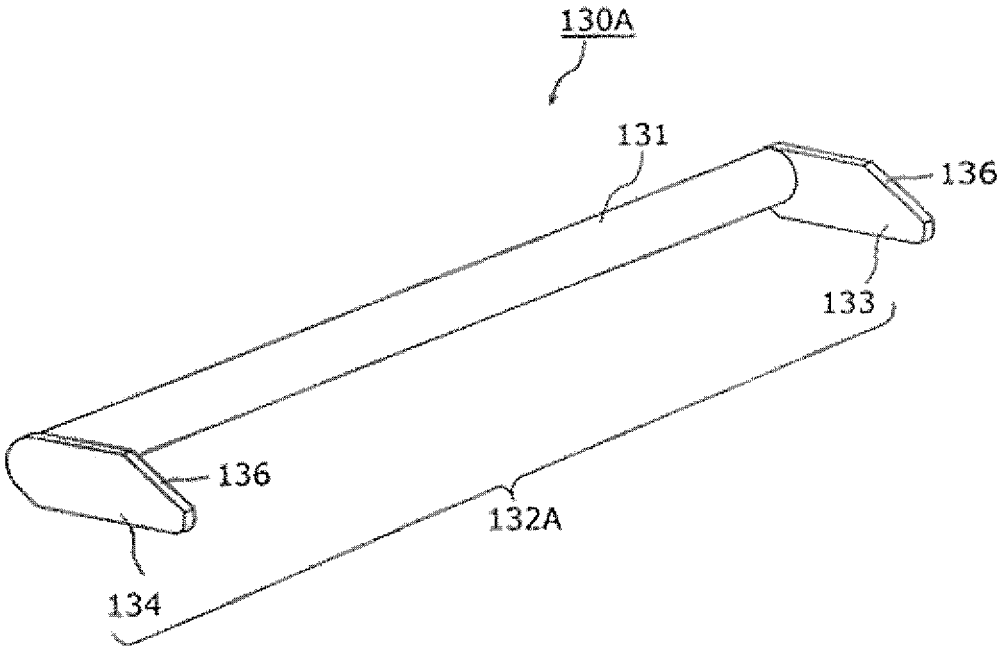
FIG. 11 is a perspective view of the displacement member of a printer of modification 1 according to one or more embodiments of the present invention.

FIG. 11 is a perspective view of a displacement member 130A of the printer according to one or more embodiments of the modification 1. In FIG. 11, identical symbols are used for configuration elements identical to FIG. 3, and their description is omitted.

The displacement member 130A has two levers 132A. The two levers 132A contain a first lever 133 and a second lever 134. In other words, in the displacement member 130A of the present modification, the third lever 135 contained in the displacement member 130 of the above embodiments is missing. However, because the first lever 133 and the second lever 134 are provided, the displacement member 130A can accurately detect the passage of the end edge 201 of the paper 200 if, for example, the size of the paper 200 is constant.

As above, even with the displacement member 130A of the present modification, if, for example, the size of the paper 200 is constant, an abnormality in the feed condition of the paper 200 can be detected.

(Modification 2)

A modification 2 of the embodiments is described next. In one or more embodiments of the present modification, the shape and number of the lever contained in the displacement member is different than the above embodiments. The displacement member is described below centered on points that differ from the above embodiments.

Figure 12:
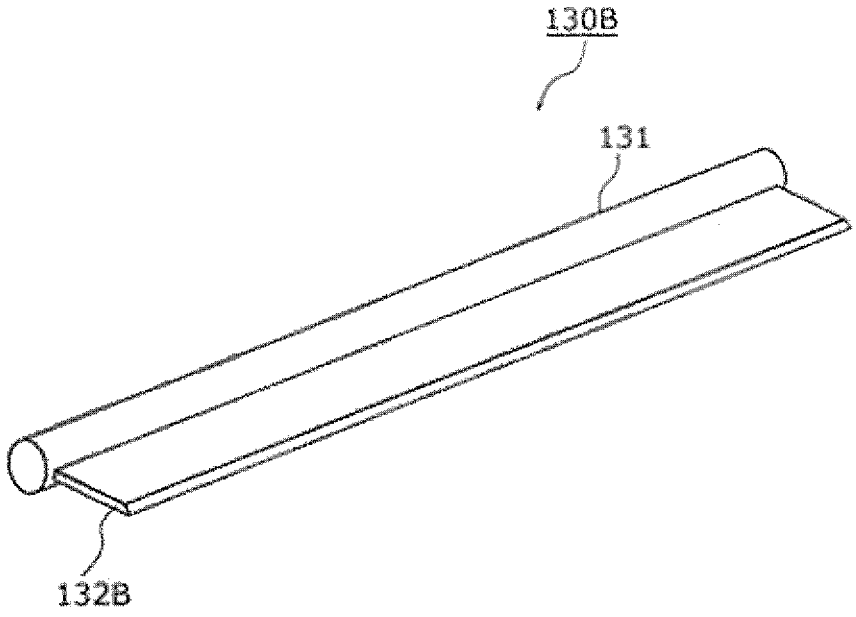
FIG. 12 is a perspective view of the displacement member of a printer of modification 2 according to one or more embodiments of the present invention.

FIG. 12 is a perspective view of the displacement member 130B of the printer according to one or more embodiments of the modification 2. In FIG. 12, identical symbols are used for configuration elements identical to FIG. 3, and their description is omitted.

The displacement member 130B is equipped with a shaft 131 and a lever 132B. The lever 132B is provided longitudinally over the shaft 131, and is a plate-shaped member disposed so it protrudes facing the route surface 112*a* of the discharge route 112. Even when the lever 132B is shaped in this manner, the displacement member 130B can accurately detect the passage of the paper 200.

As above, even with the displacement member 130B of the present modification, abnormalities in the feed condition of the paper 200 can be detected.

(Modification 3)

A modification 3 of the embodiments is described next. In one or more embodiments of the present modification, the position of the lever contained in the displacement member is different than the above embodiments. The displacement member is described below centered on points that differ from the above embodiments.

Figure 13:
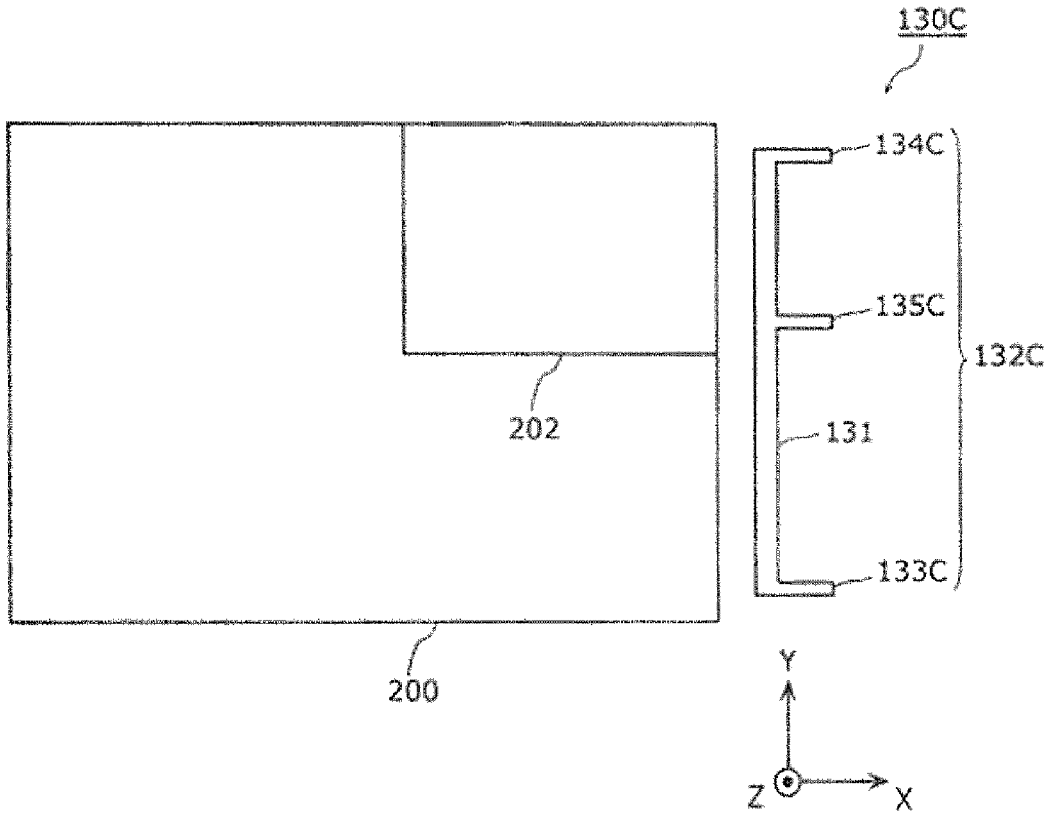
FIG. 13 is a perspective view of the displacement member of a printer of modification 3 according to one or more embodiments of the present invention.

FIG. 13 is a drawing illustrating the relationship between the displacement member 130C of the printer according to one or more embodiments of the modification 3 and a paper. In FIG. 13, identical symbols are used for configuration elements identical to FIG. 3, and their description is omitted.

The printer 100 of the present modification can perform double-sided printing on a paper 200 of a first size, and a paper 202 of a second size that is smaller than the first size.

The displacement member 130C is equipped with a shaft 131 and a plurality of levers 132C. The plurality of levers 132C contains a first lever 133C, a second lever 134C, and a third lever 135C. In the present modification, the shape and size of the first lever 133C, the second lever 134C, and the third lever 135C are the same shape and size as the first lever 133, the second lever 134, and the third lever 135 of the embodiments.

The first lever 133C and the second lever 134C are disposed in position corresponding to both end parts of the paper 200 of the first size. In other words, the first lever 133C and the second lever 134C are disposed at the passing position of both end parts of the paper 200 of the first size.

The third lever 135C is disposed in a position between the first lever 133C and the second lever 134C, in the position corresponding to the end part of one end of the paper 202 of the second size. The second lever 134C is disposed in the position corresponding to the other end part of the paper 202 of the second size. In other words, the second lever 134C and the third lever 135C are disposed at the passing position of both end parts of the paper 202 of the second size.

As above, according to the displacement member 130C of the present modification, the third lever 135C is disposed in a position corresponding to one end part in the width direction of the paper 202 of the second size, in a position that is between the first lever 133C and the second lever 134C. Thus, the change in the reverse feed amount relative to the forward feed amount due to a slant in the paper 202 of the second size can be detected more accurately. In other words, in addition to the paper 200 of the first size, abnormalities in the feed condition of the paper 202 of the second size can be more accurately determined.

(Other Modifications)

Embodiments of the present invention were described above, but the present invention is not limited to these embodiments. To the extent that it does not deviate from the meaning of the present invention, a variety of modifications as conceived by a person ordinary skill in the art applied to one or more embodiments of the present invention are included in the scope of the present invention.

For example, in the above embodiments, the printer was a laser printer, but it is not limited to this. For example, the printer may be an inkjet printer.

In the above embodiments, double-sided printing was performed on a paper, but is not limited to this. The printer may, for example, perform double-sided printing on a sheet-shaped polymer, metal, cloth, or the like. In other words, the object of printing and feeding is a sheet-shaped recording medium.

In the above embodiments, an example wherein the detector detected the rotation of the shaft of the displacement member using a photointerrupter, but it is not necessary to use a photointerrupter. For example, the detector may detect the rotation of the shaft of the displacement member using a photoreflector. In other words, the detector may detect in any manner if it can detect the displacement of the displacement member due to the paper passing through.

In the above embodiments, the number of levers was three or fewer, but it may be four or more. Also, the shape and size of the lever need not be limited to the size and shape of the lever of the above embodiments. For example, the lever may be pole-shaped.

In the above embodiments, the displacement member was supported to allow rotation around the width direction, but it does not need to rotate. For example, the displacement member may be supported to allow movement in the direction of the intersection with the route surface of the discharge route. In this case, the displacement member moves, for example, in a vertical direction when it contacts the paper. The detector should then detect the movement of the displacement member.

One or more embodiments of the present invention may, for example, be applied to a laser printer and an inkjet printer that can perform double-sided printing.

DESCRIPTION OF SYMBOLS

100 Printer
101 Chassis
102 Discharge port
103 Catch tray
104 Paper cassette
110 Feed roller
111 Supply route
112 Discharge route
113 Reverse route
120 Print unit
121 Photoreceptor drum
122 Transcription roller
123 Fixing roller
130, 130A, 130B, 130C Displacement member (or "detection member")
131 Shaft
132, 132A, 132B, 132C Lever

133, 133C First lever
134, 134C Second lever
135, 135C Third lever
136 Slanted part (or "slant")
141 Detector
142 Determining part
143 Controller

What is claimed is:

1. A printer that reverses a direction of movement of a medium, comprising:

a detection member comprising a shaft and a plurality of levers;

a detector that detects rotation of the shaft; and a determining part that determines abnormality of a feed condition when a difference between a forward feed amount of the medium fed in a forward direction and a reverse feed amount of the medium fed in a reverse direction exceeds a threshold, wherein the detection member rotates the shaft when at least one lever contacts the medium, and the forward feed amount is measured from when the rotation of the shaft is detected until the direction of movement of the medium is reversed, and the reverse feed amount is measured from when the direction of movement of the medium is reversed until the rotation of the shaft is detected.

2. The printer according to claim 1, wherein the shaft rotates around a width direction orthogonal to the direction of movement of the medium and extends in the width direction, and the plurality of levers extend from the shaft to a route surface of a discharge route and disposed apart from each other in the width direction.

3. The printer according to claim 1, wherein the medium comprises a first medium of a first size and a second medium of a second size that is smaller than the first size, and the plurality of levers comprises:

a first lever and a second lever disposed in positions corresponding to both ends of the first medium in the width direction; and a third lever disposed in a position corresponding to an end of the second medium in the width direction.

4. The printer according to claim 1, wherein each of the plurality of levers comprises a slant that is disposed canting in the reverse direction relative to the route surface of the discharge route and that collides with the end edge of the medium being fed in the forward direction over the discharge route.

5. The printer according to claim 1, wherein the shaft is rotated by a forward passage of an end edge of the medium fed in a forward direction and a reverse passage of the end edge of the medium fed in a reverse direction.

6. The printer according to claim 1, wherein the forward feed amount is a distance of movement of the medium from when the rotation of the shaft is detected until the direction of movement of the medium is reversed, and the reverse feed amount is a distance of movement of the medium from when the direction of movement of the medium is reversed until the rotation of the shaft is detected.

7. The printer according to claim 1, wherein the forward feed amount and the reverse feed amount are determined by the number of rotations of a feed roller.

8. The printer according to claim 1, wherein the forward feed amount and the reverse feed amount are determined by time required for feeding the medium in each direction.

9. The printer according to claim 1, wherein the detector detects the rotation of the shaft by optical means.

10. The printer according to claim 1, wherein the printer stops feeding when the abnormality of the feed condition is detected.

11. A printer that reverses a direction of movement of a medium, comprising:

a rotating member;

a sensor that detects rotation of the rotating member; and a controller that controls reversing the direction of movement of the medium, wherein the rotating member rotates when the rotating member contacts the medium, and the controller determines abnormality of a feed condition when a difference between a forward feed amount of the medium fed in a forward direction and a reverse feed amount of the medium fed in a reverse direction exceeds a threshold, wherein the forward feed amount is measured from when the rotation of the rotating member is detected until the direction of movement of the medium is reversed, and the reverse feed amount is measured from when the direction of movement of the medium is reversed until the rotation of the rotating member is detected.

12. The printer according to claim 11, wherein the rotating member comprises a shaft and a plurality of levers, wherein the shaft rotates when at least one lever contacts the medium.

13. The printer according to claim 11, wherein the forward feed amount is a distance of movement of the medium from when the rotation of the rotating member is detected until the direction of movement of the medium is reversed, and the reverse feed amount is a distance of movement of the medium from when the direction of movement of the medium is reversed until the rotation of the rotating member is detected.

14. The printer according to claim 11, wherein the forward feed amount and the reverse feed amount are determined by the number of rotations of a feed roller.

15. The printer according to claim 11, wherein the forward feed amount and the reverse feed amount are determined by time required for feeding the medium in each direction.

16. A method for detecting an abnormal feed condition of a medium in a printer that reverses a direction of movement of the medium, the method comprising:

detecting a forward passage of the medium fed in a forward direction and a reverse passage of the medium fed in a reverse direction; and determining whether a difference between a forward feed amount of the medium fed in the forward direction and a reverse feed amount of the medium fed in the reverse direction is above a threshold, wherein the forward feed amount is measured from when the forward passage is detected until the direction of movement of the medium is reversed, and the reverse feed amount is measured from when the direction of movement of the medium is reversed until the reverse passage is detected.

17. The method according to claim 16, wherein the forward passage and the reverse passage are detected by a detection member comprising a shaft and a plurality of levers, wherein the detection member rotates the shaft when at least one lever contacts the medium.

18. The method according to claim 16, wherein the forward feed amount is a distance of movement of the medium from when the rotation of the shaft is detected until the direction of movement of the medium is reversed, and the reverse feed amount is a distance of movement of the medium from when the direction of movement of the medium is reversed until the rotation of the shaft is detected.

19. The method according to claim 16, wherein the forward feed amount and the reverse feed amount are determined by the number of rotations of a feed roller.

20. The method according to claim 16, wherein the forward feed amount and the reverse feed amount are determined by time required for feeding the medium in each direction.

* * * * *